US005984107A

United States Patent [19]

Bleh

[11] Patent Number: 5,984,107

[45] Date of Patent: Nov. 16, 1999

[54] VIBRATORY DRIVE FOR A SCREENING MACHINE

[75] Inventor: Klaus Bleh, Rödersheim, Germany

[73] Assignee: Svedala GfA Aufbereitungs-maschinen GmbH & Co. KG, Ketsch, Germany

[21] Appl. No.: 08/906,931

[22] Filed: Aug. 6, 1997

[30] Foreign Application Priority Data

Aug. 7, 1996 [DE] Germany ..... 196 31 849

[51] Int. Cl.[6] ..... B07B 1/28; B07B 1/44

[52] U.S. Cl. ..... 209/320; 209/366.5; 209/367

[58] Field of Search ..... 209/366.5, 367

[56] References Cited

U.S. PATENT DOCUMENTS 3,053,379 9/1962 Roder et al. ..... 209/367 X
4,340,469 7/1982 Archer ..... 209/367 X

FOREIGN PATENT DOCUMENTS 2356542 8/1976 Germany .
2630458 1/1978 Germany .
7811967 8/1978 Germany .

OTHER PUBLICATIONS

Stejskal, "Elliptical Vibratory Screening Machines with Dynamic Drive," Aufbereitungs–Technik, No. Jul. 1982, pp. 367–372.

*Primary Examiner*—Donald P. Walsh
*Assistant Examiner*—Daniel Schlak
*Attorney, Agent, or Firm*—David Newman Chartered

[57] ABSTRACT

A vibratory drive for use with a screening machine for draining and/or sizing of grain solids, the drive having two eccentric shafts which are driven synchronously and in counterrotation and which have different unbalanced masses 7, 8. The eccentric shafts are arranged as near as possible to the mass center 16 of the screening machine. The angle of the mass forces of the unbalanced masses 7, 8 of the eccentric shafts includes an angle of 60° to 90°, preferably 90°, between the main direction of oscillation 18, i.e., the long axis 19 of the ellipse oscillation as a resultant of the centrifugal forces, and the zero line 17, i.e., the tie line of the eccentric shafts.

13 Claims, 5 Drawing Sheets

VIBRATORY DRIVE FOR A SCREENING MACHINE

BACKGROUND OF THE INVENTION

The present invention relates to a screening machine for draining and/or sizing of grain solids like gravel, coal or ore.

DESCRIPTION OF THE RELEVANT ART

A screening machine is known from the publication "Siebmaschinen mit elliptischer Schwingung und dynamischem Antrieb", Aufbereitungs-Technik Nr. 7/1982, pages 367 to 372, which teaches a machine having a linear drive for draining and sizing gravel, sand and the like. On this machine, the masses creating unbalance sit on two shafts. These eccentric shafts are arranged at an angle of 40° to 50° to the main direction of oscillation and are synchronized via toothed gearing. Here the main amplitude of oscillation can be varied with equal or unequal masses in its linear or elliptical form and size. The most significant disadvantage of this known form of embodiment consists in the fact that in synchronous operation very high tooth flank forces pound in a positive and negative direction, which impairs the smoothness of running and also causes an increased temperature in the transmission. A further substantial disadvantage consists in the fact that an expensive special set of gears is needed whose susceptibility to trouble and failure rate are very high. In addition to this, in changing the distance of the eccentric shafts a different transmission is needed.

Furthermore, from DE-26 30 458 Al or DE-78 11 967 U1 a drivable vibratory transmission is known on which a gear case is screwed above the screen case on to the side walls and a crosshead. Two side unbalance gears, which remain in the position in which they are arranged in the transmission, are driven via a central shaft. The essential disadvantage of this known form of embodiment consists in the fact that the drive mechanism is applied very much outside the center of mass of the screen case which results in very high overall height of the machine. In both known screening machines, the unbalanced masses, in relation to the radial tie line of the eccentric shafts, are not opposite one another but are offset from one another by an angle of less than 180°.

From DE-23 56 542 B2 a screening machine with a triple-shaft drive is known in which the main direction of oscillation runs through the axis of the third shaft, arranged centrally.

SUMMARY OF THE INVENTION

A general object of the invention is a vibratory drive for use with a screening machine that keeps the overall height of the machine low, while allowing different oscillation patterns to be set and the direction of oscillation changed, thereby reducing operating noise and temperature.

Another object of the invention is an elliptical vibratory drive including two eccentric shafts having different unbalanced masses, wherein the mass forces of the unbalanced masses may be adjusted.

An additional object of the invention is an elliptical vibratory drive including two eccentric shafts that are driven synchronously and in counterrotation by the drive, wherein the eccentric shafts may be synchronized by means of a belt.

According to the present invention, as embodied and broadly described herein, an elliptical vibratory drive for use with a screening machine for draining and/or sizing of grain solids like gravel, coal or ore is provided. The elliptical vibratory drive comprises two eccentric shafts having different unbalanced masses which are driven synchronously and in counterrotation. A resultant of the mass forces of the unbalanced masses engages in, or in the immediate proximity of, the mass center of the screening machine, and the radial tie line of the eccentric shafts, i.e., the zero line, lies at an angle of 60° to 90° relative to the long axis of the vibratory ellipse, i.e., the main direction of oscillation.

Under the term "immediate proximity" is to be understood that the resultant of the mass forces of the unbalanced masses engages so closely to the mass center of the screening machine that the rocking of the screening machine caused by the deviation does not exceed its internal damping.

An advantageous form of embodiment consists in the fact that the mass forces of the unbalanced masses may be adjusted.

It is furthermore advantageous that the eccentric shafts may be synchronized by means of V-belts or synchronous belts.

It is furthermore proposed that the V-belts or synchronous belts be attached to a motor console stationary between the motors.

An advantageous form of embodiment provides for the eccentric shafts to be driven via gearing, the belts being fitted between the countershafts.

It is furthermore advantageous that the synchronization takes place via an electrical synchronization control system.

It is furthermore proposed that the direction of oscillation and form of the unbalanced mass be capable of being changed in size and relative position to the main direction of oscillation by manual or electrical adjustment of one or both eccentric shafts.

Finally, it is advantageous that on the motor console one or two synchronous shafts are mounted to which the cardan shafts of the motors are connected by means of the belts.

The invention brings particularly the advantage that the synchronization forces on the belts or electrical components are practically zero and there is thus no fluttering of the drive mechanism. An additional substantial advantage consists in the fact that, once the machine has been started, the smaller motor can be switched off and the residual forces of the smaller unbalanced masses taken over by the large motor, resulting in a saving of energy. Energy saving of this kind also results from the lowered temperatures and running noises. Where the axle distance of the eccentric shafts is changed, no new drive parts (e.g. gears) are necessary, which also simplifies the drive, no additional drive assemblies or turbo-coupling being necessary. The belts used effect damping through their spring action. Environmental pollution, such as is caused by oil escaping, can be avoided.

Additional objects and advantages of the invention are set forth in part in the description which follows, and in part are obvious from the description, or may be learned by practice of the invention. The objects and advantages of the invention also may be realized and attained by means of the instrumentalities and combinations particularly pointed out in the appended claims.

BRIEF DESCRIPTION OF THE DRAWINGS

The accompanying drawings, which are incorporated in and constitute a part of the specification, illustrate preferred embodiments of the invention, and together with the description serve to explain the principles of the invention.

DETAILED DESCRIPTION OF THE PREFERRED EMBODIMENTS

Figure 1:
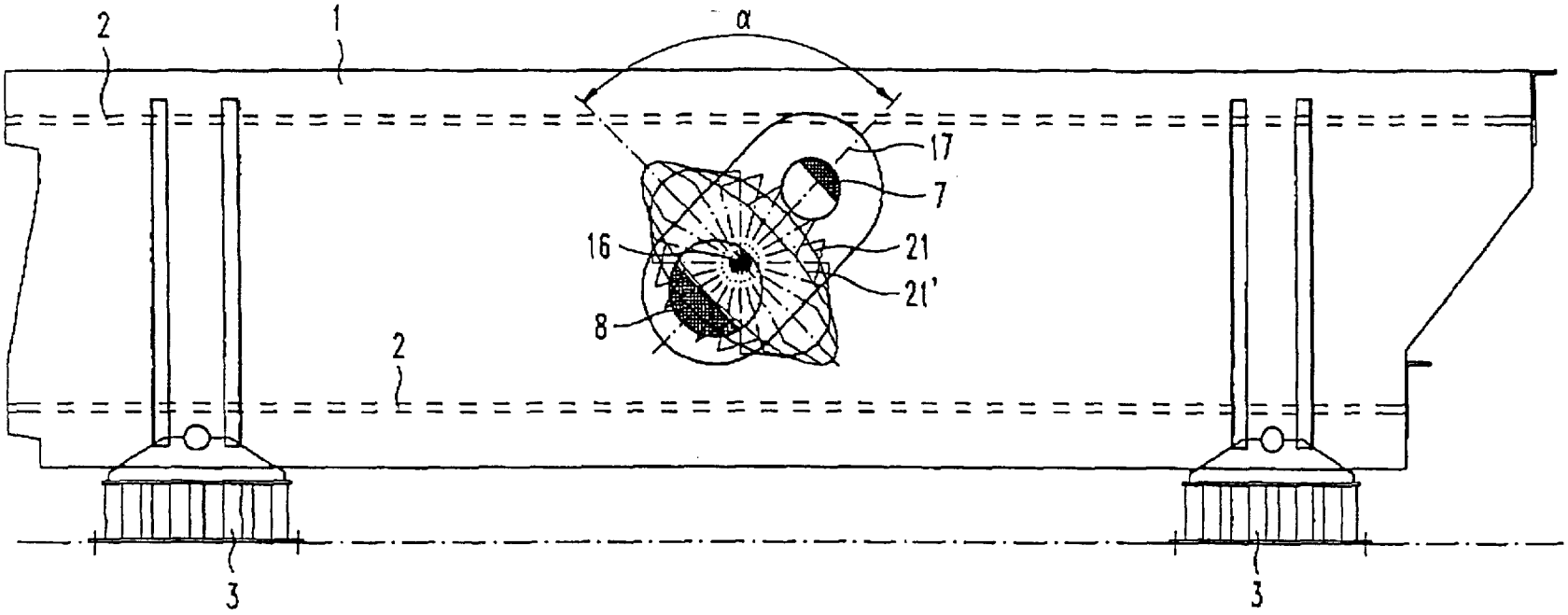
FIG. 1 illustrates a screening machine with a vibratory drive, according to the invention, in elevation with a setting of the unbalanced masses in the direction of the small ellipse axis according to the force diagram of FIG. 5.

Reference now is made in detail to the present preferred embodiments of the invention, examples of which are illustrated in the accompanying drawings, wherein like reference numerals indicate like elements throughout the several views.

Figure 2:
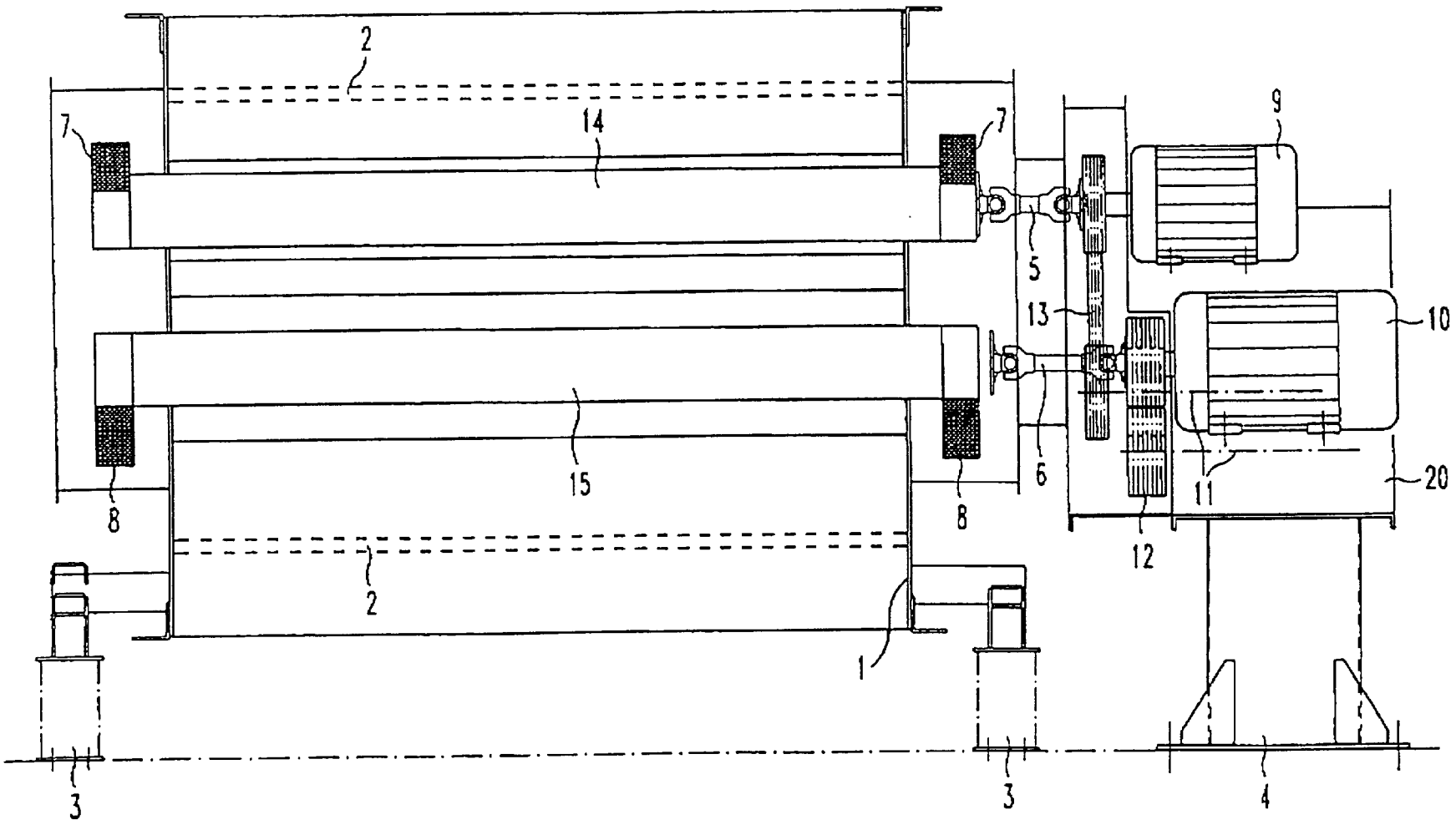
FIG. 2 shows a side view of FIG. 1.
Figure 3:
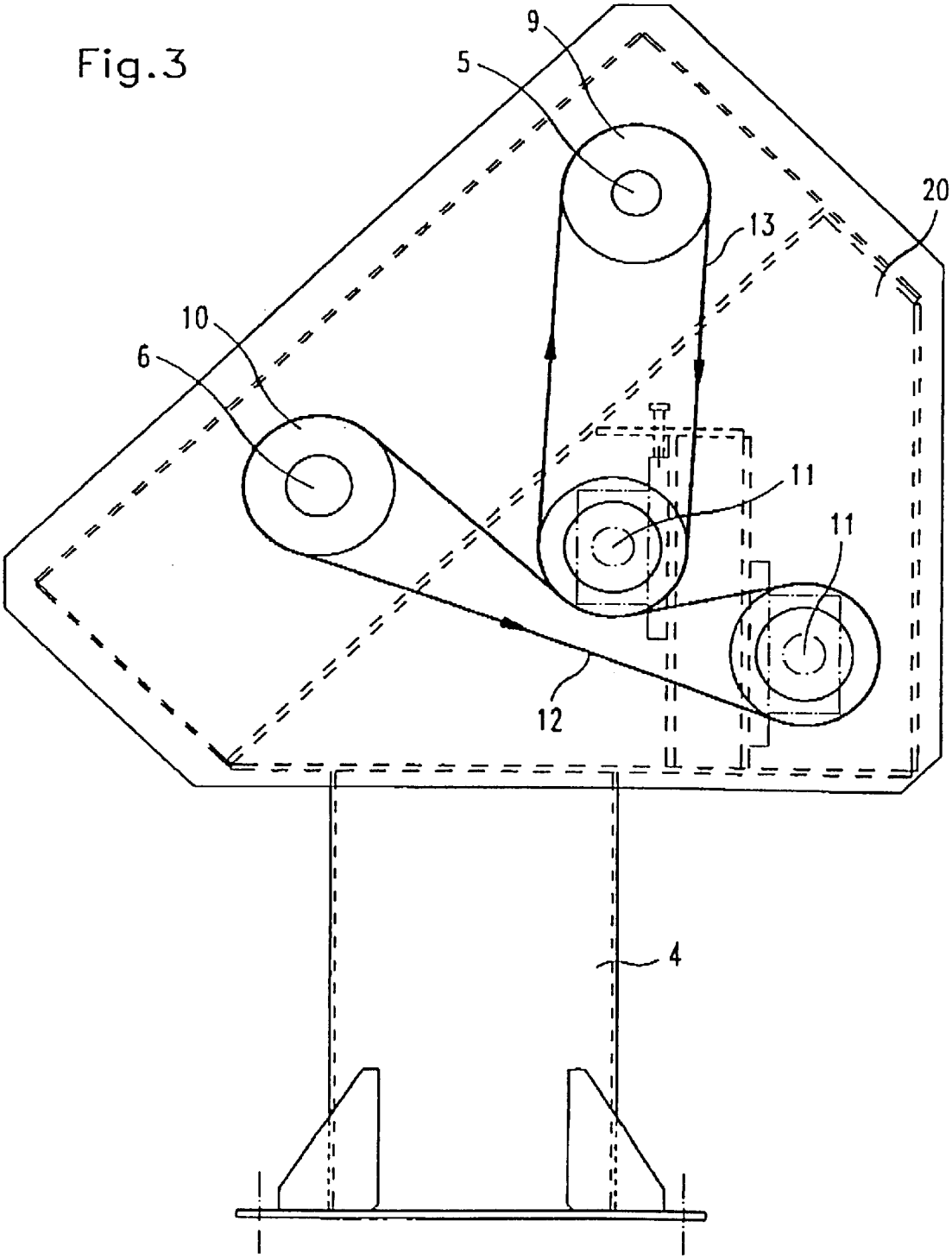
FIG. 3 depicts a view of the motor console with the different drive assemblies as per FIG. 1.

The vibratory drive shown in FIGS. 1 to 3 is attached to a screening machine with a screen case 1, screen surfaces 2 and resilient mounts 3.

As illustratively shown in FIG. 2, the actual vibratory drive consists of two unbalanced masses 7, 8 which are mounted on the screen case 1 via unbalanced shafts or eccentric shafts 14, 15. The drive of these eccentric shafts 14, 15 proceeds via cardan shafts 5, 6 which are driven by motors 9, 10, which are retained on a stationary motor console 20. The cardan shafts 5, 6, and with them also the eccentric shafts 14, 15, are synchronized via synchronous shafts 11, which are connected via belts 12, 13 to the motors 9, 10. The motor console 20 is arranged on a motor stand 4. In addition, on both sides of each eccentric shaft 14, 15 sits an unbalanced mass 7 or 8.

It is essential for the invention that the eccentric shafts 14, 15 are arranged as near as possible to the mass center 16 of the screening machine. Furthermore, the unbalanced forces 7 or 8 rotate in opposite directions and this results in an oscillating movement of the screen case as per the ellipse shown in FIGS. 1 and 5. The main direction of oscillation 18 coincides with the longitudinal axis 19 of the ellipse 21. The tie line through the middle of the eccentric shafts 14, 15 is the zero line 17, where, in addition, the resultant of the mass oscillating forces is smallest. The angle between this line 17 and the line formed by the main direction of oscillation 18 is preferably 90°, although satisfactory results may still be achieved in the region to 60° between the zero line 17 and the main direction of oscillation 18. In the "zero setting", the unbalanced masses 7, 8 lie opposite one another on the zero line 17, i.e., on the tie line of the axes of the eccentric shafts 14, 15, i.e., rotated by 180° towards one another, so that no angular acceleration or deceleration of the unbalanced masses occurs.

Figure 4:
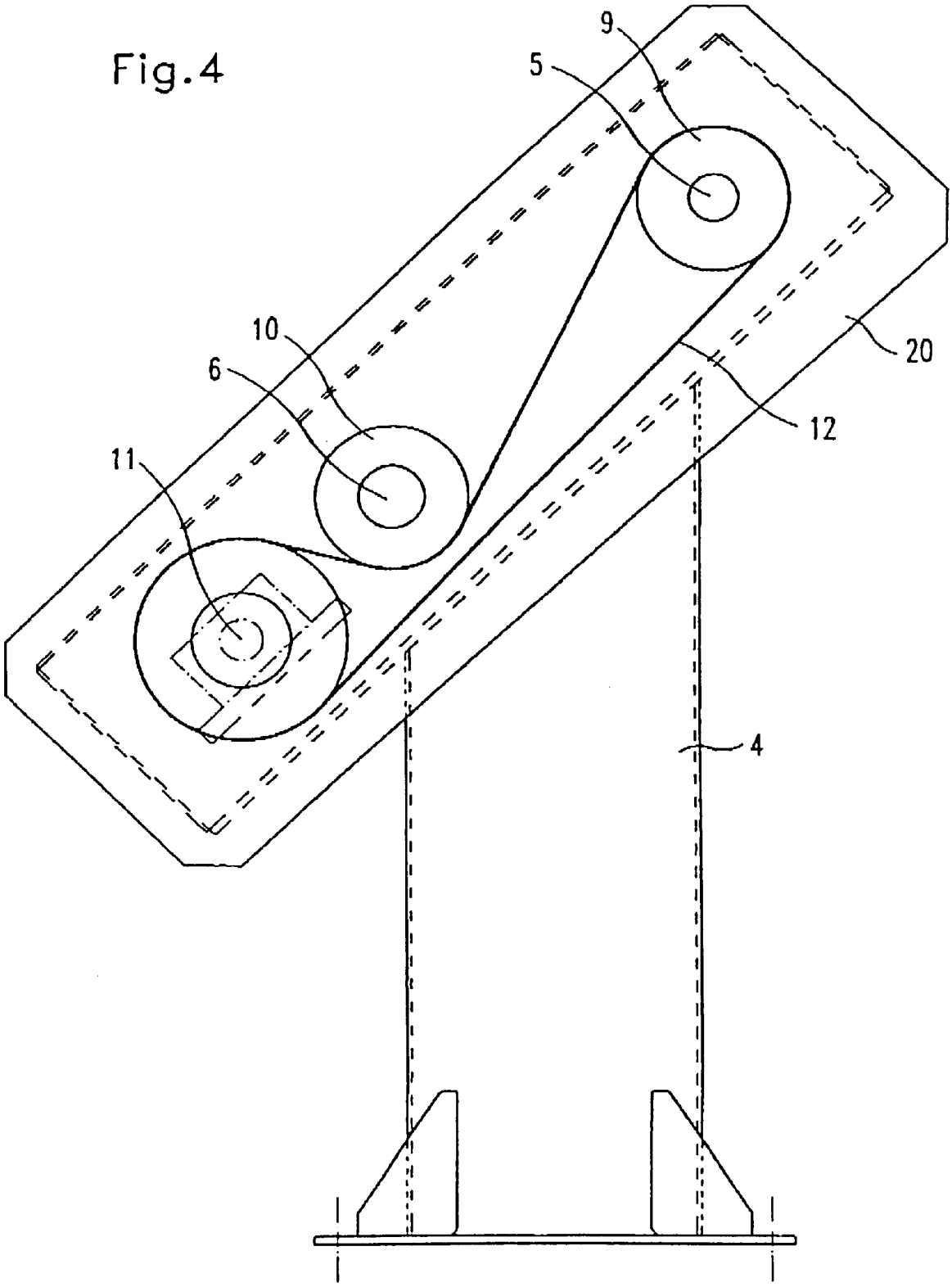
FIG. 4 illustrates a corresponding view of the motor console as per a further form of embodiment for the drive assemblies.

According to the form of embodiment shown in FIG. 4, the synchronization of the two cardan shafts 5, 6 takes place via a single synchronous shaft 11 and a single belt 12 which connects the motors 9, 10 and the synchronous shaft 11.

Figure 5:
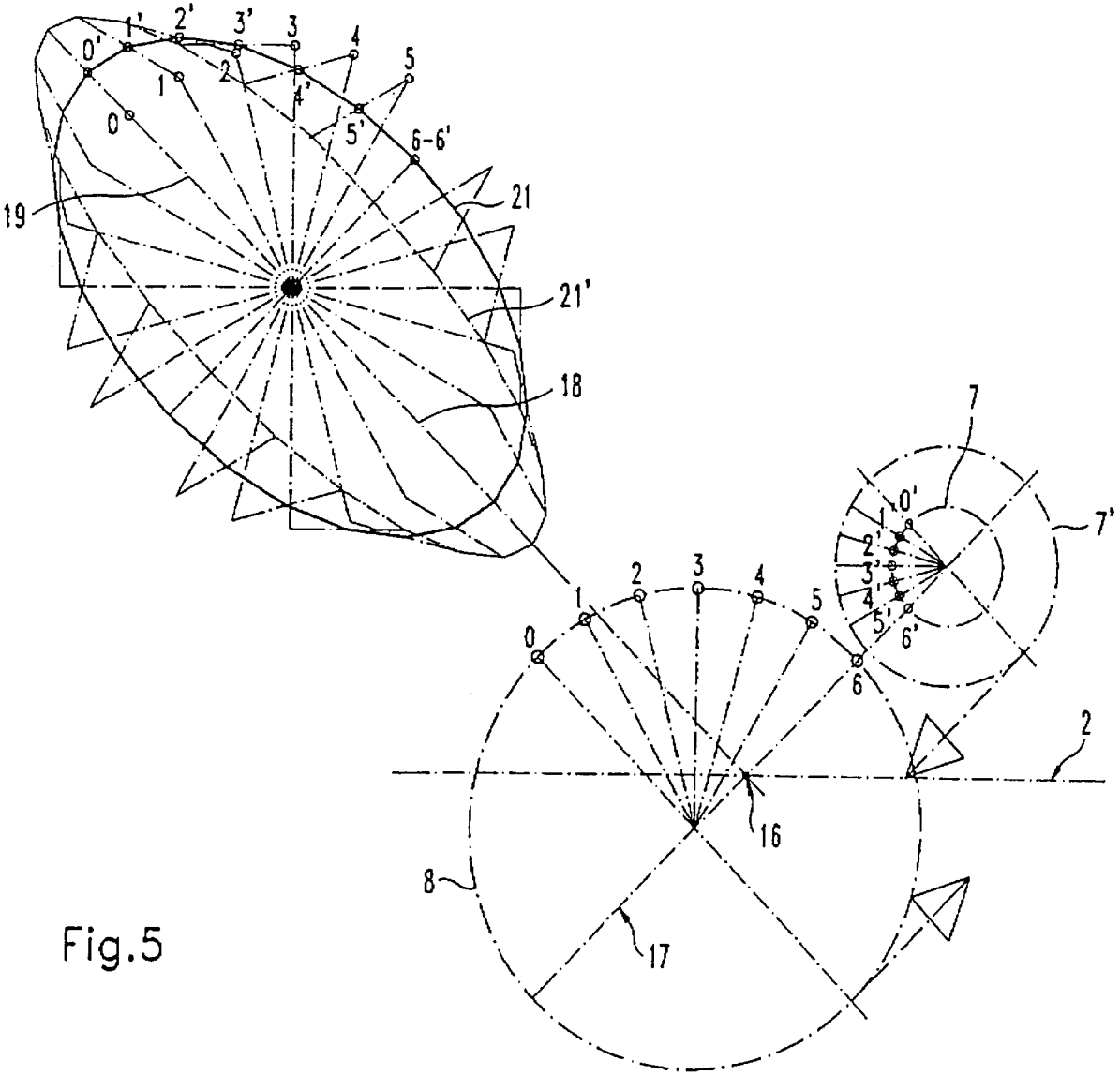
FIG. 5 shows the force diagram for the vibratory drive shown.

The force diagram is shown in FIG. 5. The two circles shown in broken lines symbolize the circulating unbalanced masses 8 or 7, unbalanced mass 7 being shown in two dimensions, namely as a smaller unbalanced mass and in dash-dot lines as a larger unbalanced mass 7'. Correspondingly, an ellipse 21 or an ellipse 21' arises with the larger unbalanced mass 7'. With the aid of the parallelogram of forces, the resultant can be produced whose locus curve is ellipse 21. Some points of the unbalanced mass positions are drawn in, these being points 0 to 6 or 0' to 6'. From the diagram it can also be easily seen that the angle between the long ellipse axis 19 and the zero line 17 is 90°.

By changing the unbalanced masses, the mass forces can also be set in the required form, i.e., the form and size of the unbalanced masses may be altered to adjust the mass forces. Similarly, the position of the unbalanced masses relative to the main direction of oscillation 18, as well as the direction of oscillation of the masses relative to the main direction of oscillation, may also be adjusted. These adjustments may be made either manually or electrically.

The synchronization of the two eccentric shafts 14, 15 can also be effected by an electrical synchronization control system. The eccentric shafts 14, 15 can also be driven by gears, with corresponding drive belts then being fitted between the countershafts.

It will be apparent to those skilled in the art that various modifications can be made to the vibratory drive for a screening device of the instant invention without departing from the scope or spirit of the invention, and it is intended that the present invention cover modifications and variations of the vibratory drive for a screening device provided they come within the scope of the appended claims and their equivalents.

I claim:

1. An elliptical vibratory drive for use in a screening machine, the screening machine for draining and sizing of grain solids and including a screening frame suspended on a machine stand, said elliptical vibratory drive consisting essentially of:

two eccentric shafts, said shafts having different unbalanced masses and being driven synchronously and in counterrotation by said drive;

with a resultant of mass forces of said unbalanced masses engaging in immediate proximity of a mass center of the screening machine, and with an angle between a radial tie line of said eccentric shafts and a long axis of a vibratory ellipse having between 60° and 90°.

2. The elliptical vibratory drive as set forth in claim 1, wherein the mass forces of the unbalanced masses may be adjusted.

3. The elliptical vibratory drive as set forth in claim 2, wherein the eccentric shafts are synchronized by means of a belt.

4. The elliptical vibratory drive as set forth in claim 3, wherein the belt is attached to a motor console stationary between two motors.

5. The elliptical vibratory drive as set forth in claim 4 wherein the eccentric shafts are driven by gears, the belt being fitted between countershafts.

6. The elliptical vibratory drive as set forth in claim 1 wherein the two eccentric shafts are driven synchronously.

7. The elliptical vibratory drive as set forth in one of claims 1, 3, 4, 5 or 6, wherein a direction of oscillation and form of the unbalanced masses may be altered in size and relative position to the main direction of oscillation by one of manual and electrical adjustment of at least one of said eccentric shafts.

8. The elliptical vibratory drive as set forth in claim 4 or 5, further comprising a synchronous shaft, mounted on a motor console, via which a cardan shaft of the motors is connected by means of the belt.

9. An elliptical vibratory drive for use in a screening machine consisting essentially of:

two eccentric shafts, said shafts having different unbalanced masses and being driven synchronously and in counter-rotation to generate an oscillation, the oscillation having a main direction;

two motors, coupled to said two eccentric shafts, respectively, for turning the two eccentric shafts in counter-rotation, each of said two motors having a cardan shaft for connecting a respective motor to a respective eccentric shaft;

a motor console for housing the two motors;

a synchronous shaft, mounted on the motor console;

a belt for connecting the synchronous shaft to the cardan shafts of the two motors, thereby synchronizing the turning of the eccentric shafts; and wherein a resultant of mass forces of said unbalanced masses engages in immediate proximity of a mass center of the screening machine, and a radial tie line of said two eccentric shafts lies at an angle of between 60° and 90° relative to the main direction of oscillation.

10. The elliptical vibratory drive as set forth in claim 9, wherein the mass forces of the unbalanced masses may be adjusted.

11. The elliptical vibratory drive as set forth in claim 9, wherein the eccentric shafts are driven by gears, the belt being fitted between countershafts.

12. The elliptical vibratory drive as set forth in claim 9 wherein the two eccentric shafts are driven synchronously responsive to an electrical synchronization control system.

13. The elliptical vibratory drive as set forth in claim 9 or 10, wherein a direction of oscillation and form of the unbalanced mass may be altered in size and relative position to the main direction of oscillation by one of manual and electrical adjustment of at least one of said two eccentric shafts.

* * * * *